US007318767B2

(12) United States Patent
Simakov et al.

(10) Patent No.: US 7,318,767 B2
(45) Date of Patent: Jan. 15, 2008

(54) DEVICE AND METHOD FOR MACHINE CONTROL

(75) Inventors: Michael Simakov, Brighton (AU); Christian Dilger, Ditzingen (DE)

(73) Assignee: Ruger, Barthelt & Abel, Esslingen a.N. (DE)

( * ) Notice: Subject to any disclaimer, the term of this patent is extended or adjusted under 35 U.S.C. 154(b) by 505 days.

(21) Appl. No.: 10/957,633

(22) Filed: Oct. 5, 2004

(65) Prior Publication Data

US 2006/0073764 A1 Apr. 6, 2006

(51) Int. Cl.
*B24B 49/00* (2006.01)
*B24B 51/00* (2006.01)
*G06F 15/00* (2006.01)

(52) U.S. Cl. ..... 451/5; 451/9; 451/10; 451/178; 700/96; 702/167

(58) Field of Classification Search ..... 451/1, 451/5, 8, 9, 10, 11, 178; 700/28, 95, 96, 700/108, 109, 245; 702/33, 155, 167; 715/961, 715/965, 966
See application file for complete search history.

(56) References Cited

U.S. PATENT DOCUMENTS 4,513,366 A * 4/1985 Munekata et al. ..... 700/178
4,700,313 A * 10/1987 Takagawa ..... 700/185
5,079,713 A * 1/1992 Kawamura et al. ..... 700/178
5,122,966 A * 6/1992 Jansen et al. ..... 700/178
5,247,451 A * 9/1993 Sawamura et al. ..... 700/178
5,307,282 A * 4/1994 Conradson et al. ..... 700/103
5,363,308 A * 11/1994 Guyder ..... 700/187
5,739,660 A * 4/1998 Gnann ..... 318/626
5,857,815 A * 1/1999 Bailey et al. ..... 409/201
6,112,133 A * 8/2000 Fishman ..... 700/182
6,290,571 B1 * 9/2001 Dilger et al. ..... 451/5
6,311,100 B1 * 10/2001 Sarma et al. ..... 700/190
6,411,862 B1 * 6/2002 Hazama et al. ..... 700/182
6,678,582 B2 * 1/2004 Waled ..... 700/245
6,757,582 B2 * 6/2004 Brisson et al. ..... 700/186
6,901,309 B2 * 5/2005 Hertinger ..... 700/174
7,003,373 B2 * 2/2006 Baumann et al. ..... 700/189

FOREIGN PATENT DOCUMENTS

DE 196 00 538 7/1997
EP 0 415 067 3/1991
EP 0 439 655 8/1991
GB 2140937 A * 12/1984

* cited by examiner

*Primary Examiner*—Timothy V. Eley
(74) *Attorney, Agent, or Firm*—Drinker Biddle & Reath LLP

(57) ABSTRACT

A data set (D) is provided for machine control of a grinding machine to determine time-efficient, collision-free travel paths. The data set has a collision parameter of "0" or "1" in each separate coordination point (X, Y, Z, A) as well as for each combination of the separated tool types (WZI) and workpiece types (WSJ). The collision parameter indicates if the constellation assigned to the corresponding coordination point (X, Y, Z, A), which means the relative position of workpiece (11) and tool (3), does or does not result in a collision or spatial overlapping of the tool and the workpiece. The data base (D) forms a lookup table that can be used to check given paths or expansions or the step-by-step layout of paths. The computation of time-efficient paths can be performed within a few seconds, even at limited computing capacities.

13 Claims, 3 Drawing Sheets

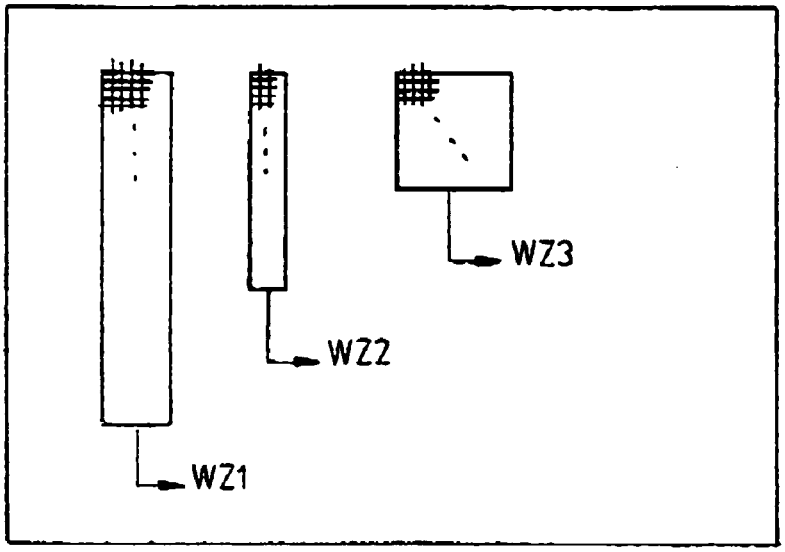
Fig.3
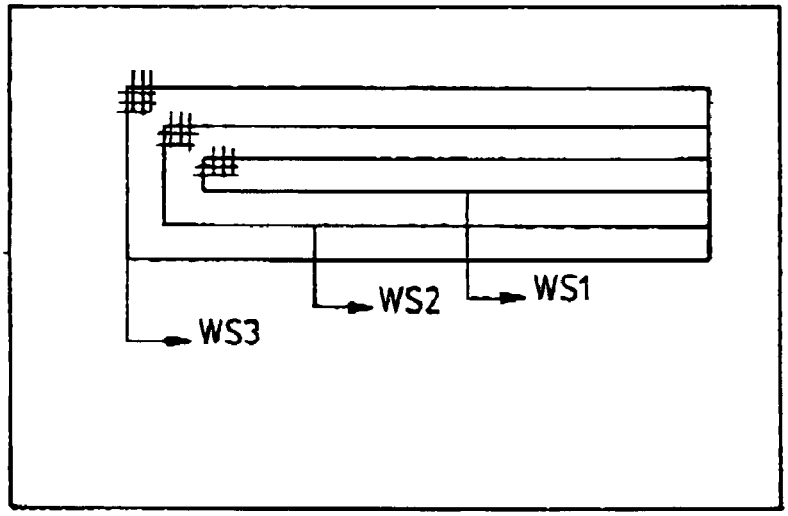
Fig.4
D = (WZ1, WZ2, WZ3. . .) overl (WS1, WS2, WS3. . .)
R
Fig.5

DEVICE AND METHOD FOR MACHINE CONTROL

BACKGROUND

The invention relates to a machine control device for a grinding machine or for comparable machines and a method to determine the travel path of a tool, particularly a grinding tool and/or a corresponding workpiece.

On grinding machines or similar machines, as for example erosion machines or the like, it is frequently necessary to adjust the workpiece and/or the tool relative to one another so that a collision cannot occur. For example, this is the case when the machining process performed with a grinding tool is completed and another grinding tool is to be brought into contact with the workpiece. The positioning of the workpiece and the grinding tool as well as the control of paths to be traveled is an object in the machine control program that a machine adjustment specialist or a machine operator has to achieve with more or less intelligent programming assistance. As a rule, it is not possible for the machine adjustment specialist to provide position paths that are optimal time wise. This applies especially when these paths cannot be linear to bypass obstacles and to avoid collisions thereby. If a machine control program has been created, then it has to be carefully tested over a long period for its freedom of collision to avoid the case where grinding tools or workpieces collide with one another or that they collide with other parts. If obviously safer paths are taken to avoid collisions whereby after the end of an operation the respective tool is moved to a so-called safe parked position, for example, and whereby the starting position of the subsequent operational step is approached from said parked position—or whereby another parked position is approached from said first parked position—then this results in lengthy travel paths and long positioning times. The positioning times add up to a considerable loss of time, which is to be avoided, particularly during grinding operations on complicated workpieces, as for example drills, cutters or the like.

It is therefore an object of the invention to provide a positioning method as well as a corresponding machine control device with which travel paths for tools and/or workpieces can be determined in a short time and in a simple manner requiring a short positioning time.

SUMMARY OF INVENTION

This object is achieved by a workpiece-shaping machine which comprises a shaping tool carrier and a workpiece carrier, a multi-axial actuation device, and a machine control device. The shaping tool carrier and the workpiece carrier are arranged for relative movement in a plurality of directions within a working area. The multi-axial actuation device produces the relative movement. The machine control device is connected to the multi-axial actuation device and includes a processing unit, and a memory unit connected to the processing unit. The memory unit includes a pre-computed data base for the working area, which area is divided into coordinates. Collision parameters are pre-assigned to the coordinates for predetermined shaping tools and predetermined workpieces in respective predetermined positions thereof. The machine control device is operable to map out a freedom-from-collision travel path based upon the collision parameters.

The invention also pertains to a method of mapping out a freedom-from-collision travel path utilizing the above-described apparatus. The method comprises that the steps of:

A) causing the memory unit to pre-assign collision parameters to the coordinates for predetermined shaping tools and Predetermined workpieces in respective predetermined positions thereof, and B) causing the machine control device to map out a freedom-from-collision travel path based upon the collision parameters.

The machine control device according to the invention assists the programmer in the input or determination of travel paths requiring a short positioning time. Said machine control device can also be equipped to determine such travel paths automatically. The characteristic of the machine control device and the associated control method is based on the fact that a pre-computed data base is provided, which applies to the separated working area and which contains a collision parameter for each tool and each tool position as well as for each workpiece and each workpiece position as well as for each separation element of the working area. For example, this parameter is "zero" when there is no collision and "one" when the respective workpiece position and the tool position collide (whereby said tool position is determined by a location in the area of the machine coordinates), which means an overlapping path of tool and workpiece. If a special path of the workpiece is provided through the working area and/or of the tool through the working area, then there can be determined through a simple search of the data base whether the proposed path includes collisions or not. This can be achieved in the way of checking predetermined paths and it can also be a supporting measure during the determination of travel paths.

The search of the data base is an extremely time-intensive process, but it has to be performed only one time. For example, if a working area is divided into one hundred separate steps in all three spatial directions, 10,000 separation elements are created. For example, a first and also separated tool can assume 10,000 different positions at a predetermined orientation of the workpiece. If the workpiece can assume 100 separate orientations, then the separate working area has 1,000,000 points. A collision parameter of "0" or "1" is assigned to each separation element (cell) in the entire working area for each point, which means for each separate workpiece-tool constellation (workpiece position and tool position in the working area). If the workpiece and the tool does not come into contact with one another or overlap each other, then all cells are "zero". If contact or overlapping occurs, then only the specific cells are "ones" in which there is contact or overlapping, for example.

Determination of the collision parameters in the above-mentioned manner occurs preferably now for each separated type of tool in combination with each separated type of workpiece whereby preferably the geometric shape of the unfinished pieces are selected as workpieces. All these constellations are then entered into the data base. It has been shown that the computation of such a data base can take more than a day even on highly efficient computers. The data base forms then a lookup table through which a proposed path of a grinding tool and/or a workpiece can be checked for freedom from collision within a few seconds or even faster at a corresponding arrangement of data. The inventive method and the machine control device achieve thereby an individual basis to be able to check for freedom from collision during programming of travel paths or during the automatic creation of said travel paths. In particular, time-efficient travel paths can be determined very rapidly through repeat return to the data base.

The data base has to be established only one time by the machine manufacturer. This data base can subsequently be copied onto all existing machines or grinding machines and it makes the determination of a favorable travel path possible then. For example, a collision-free path is selected additionally between all conceivable paths between a starting point and an end point of the path to be determined, which is as close as possible near an optimum path. Known standardized methods can be used in addition. In individual cases it may be sufficient if the data base includes only the separation elements of the working area and its collision parameters, which have to be checked during positioning. Separation elements associated with marginal regions of the working area may be possibly omitted. However, it is considered to be advantageous to include all separation elements of the working area so that each conceivable case of collision is contained in the data base.

Moreover, it is preferred to consider all tools used on the respective machine whereby the tools are described by tool separation elements forming a respective type of a tool. Workpieces are also separated whereby the unfinished pieces to be machined on the respective grinding machine serve separately as designs for workpieces and whereby said workpieces have simple geometric shapes such as cylinders, cones, stepped cylinders or the like.

The method is especially suitable for use on grinding machines having only a small amount of material to be cut so that the workpiece is changed in its shape only to a small degree during machining. The workpiece designs of the unfinished pieces remain generally the same even with the machining process on the workpieces.

The data base consists of an indexed listing, which means a chain of zeros appear in the rule. Said data base can thereby easily compressed from the start. Data compression can be performed and respectively limited to the pairing of tool types and workpiece types so that only a partial data base has to be decompressed (unpacked) to check freedom from collision of paths of a specific workpiece and of a specific tool.

Additional details of advantageous embodiments of the invention are shown in the drawings, the description, or the claims.

BRIEF DESCRIPTION OF DRAWINGS

An embodiment example is illustrated in the drawings:

FIG. 3 shows in a schematic illustration a supply of separated tool types;

FIG. 4 shows in a schematic illustration another supply of separated tool types;

FIG. 5 shows as a formula the structure of the data base determining the collision parameters;

DESCRIPTION OF PREFERRED EMBODIMENTS

Figure 1:
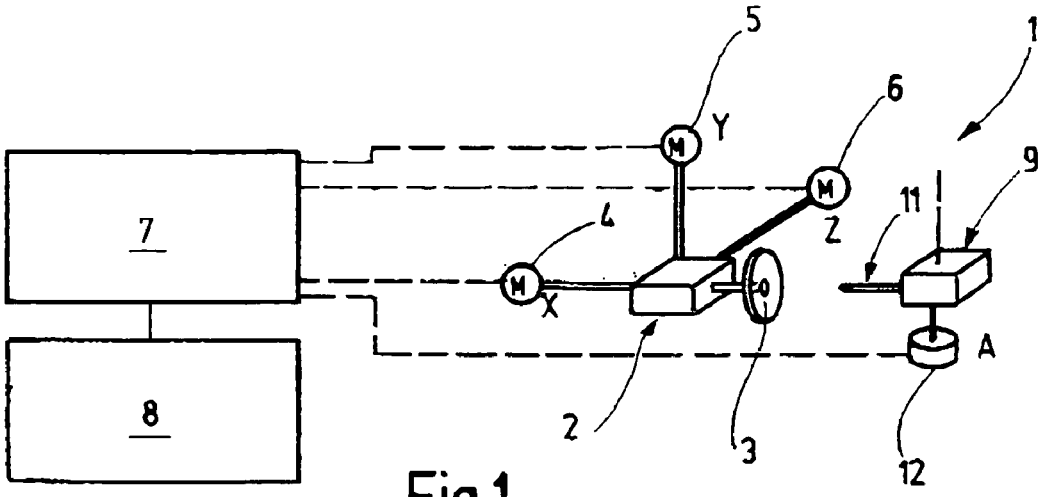
FIG. 1 shows a grinding machine and its control device in a highly schematic illustration.

A grinding machine 1 is shown in FIG. 1 in a highly schematic illustration. Said grinding machine 1 comprises a grinding spindle carrier 2 with a grinding tool 3, i.e. a grinding wheel. The grinding spindle carrier 2 can be adjusted linearly in several directions—for instance in three directions X, Y, Z. Corresponding drives 4, 5, 6 serve for adjustment whereby said drives are connected to a control device 7 via control lines. Said control device is a machine control computer, for example, which is connected to a memory unit 8. The grinding machine 1 comprises additionally a workpiece carrier 9 into which a rod-shaped unfinished piece 11 is mounted in FIG. 1 as an example. For example, the workpiece carrier 9 can be mounted rotatably about axis A. A corresponding drive 12 is connected to the control unit 7. If the grinding spindle carrier 2 is movable only in the Y and Z direction, then the workpiece carrier 9 may additionally be movable in X direction. The drive 4 is then connected to the tool carrier 9.

Figure 2:
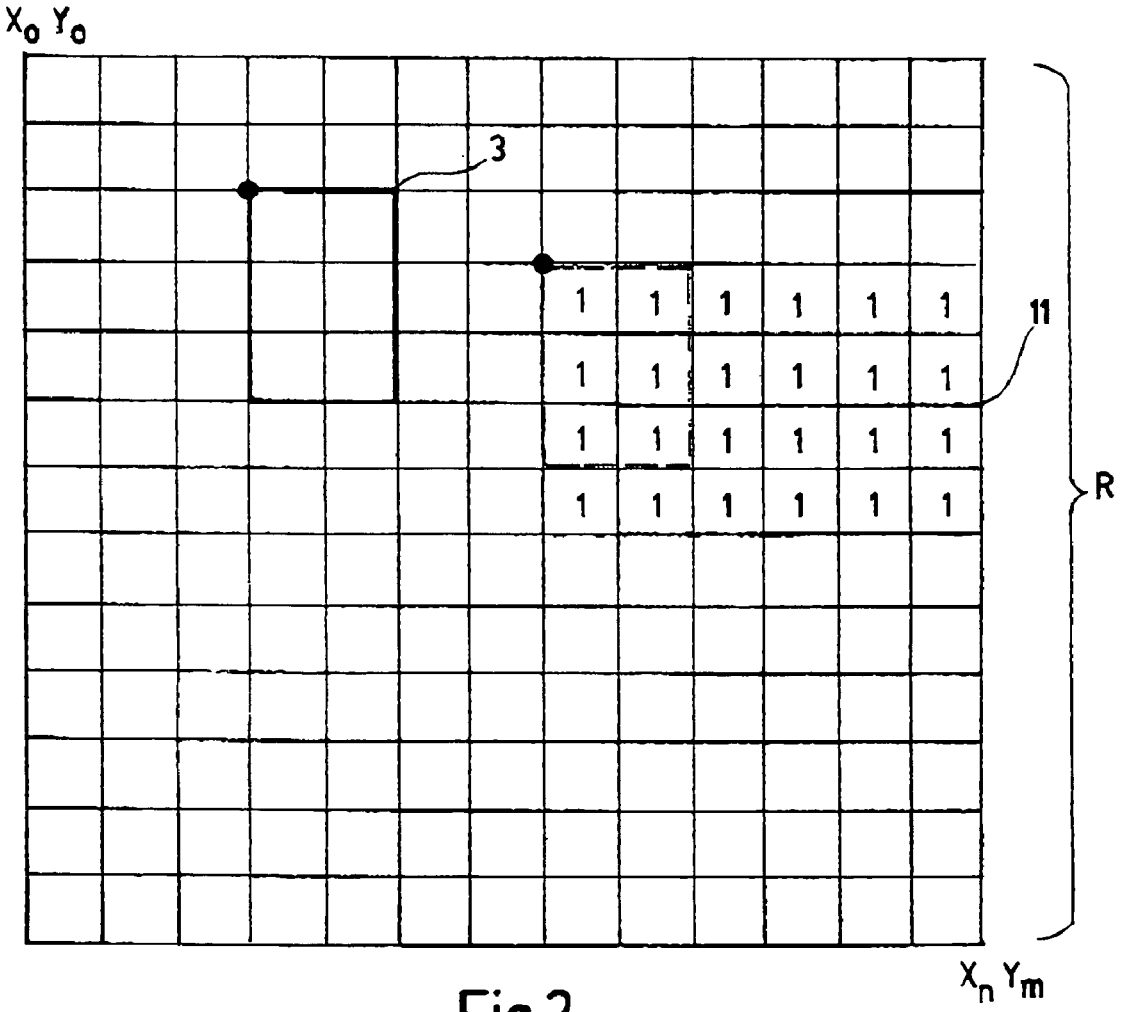
FIG. 2 shows in a schematic illustration a two-dimensional separated working area together with a separated workpiece type and a separated tool type overlapping each other.

The coordinates X, Y, Z and A form a four-dimensional working area for the movement of the grinding wheel 3 and the unfinished piece 11. The control device 7 controls the movement of the grinding wheel 3 and the unfinished piece 11 to achieve desired grinding results. It additionally controls the movement of the grinding wheel 3 and/or the unfinished piece 11 to be able to bring different tools into contact with the unfinished piece 11 one after the other, for example. The grinding spindle carrier 2 and the workpiece carrier 9 must be moved thereby in the shortest time possible, which means that time-optimal or nearly time-optimal or at least time-efficient travel paths are searched for. Above all, there must not occur thereby any collisions between the grinding wheel 3 and the unfinished piece 11 or any other elements. The control device 7 is therefore in a position to check the proposed paths for collision in the four-dimensional working area. It uses thereby a data base provided in the memory unit 8 containing a collision parameter for all possible positions of the grinding wheel 3 and the unfinished piece 11 in the separated four-dimensional working area. This means that for all separated X, Y and Z positions of the grinding wheel 3, combined with all separated rotating positions (A positions) of the unfinished piece 11, a determination is made if overlapping (collision) occurs relative to the volume of the grinding wheel 3 and the unfinished piece 11. A two-dimensional example is shown in FIG. 2 for a working area R to illustrate this event. Its separated coordinates extend from $X_0$ to $X_n$ and from $Y_o$ to $Y_m$. The separated working area R includes thereby all possible separate relative positions of the grinding wheel 3 and the workpiece 11 if only an adjustment in two axes is provided (adjustment in X and in Y). The tool 3, which is identified by the coordinates $X_k$, $Y_1$, is now experimentally moved in each point of the separate working area whereby its coordinates $X_k$, $Y_1$ are assigned the collision parameter "1" when overlapping exists—otherwise it is "0". The grid squares "0" are shown empty in FIG. 2. The collision parameters "0" and "1" are also correspondingly determined for a three-dimensional or a four-dimensional working area, which means that the respective collision parameter is determined for each possible position of the tool 3 or each possible position of the workpiece 11. The collision parameters are stored as data base D in the memory unit 8. Expressed schematically, the data base D includes the overlapping of tool 3 with the workpiece 11 for the entire working area R. The overlapping, which is schematically shown here as operator "overl", contains the test of intersection for each relative position of tool 3 and the workpiece 11 in the separated working area.

Figure 6:
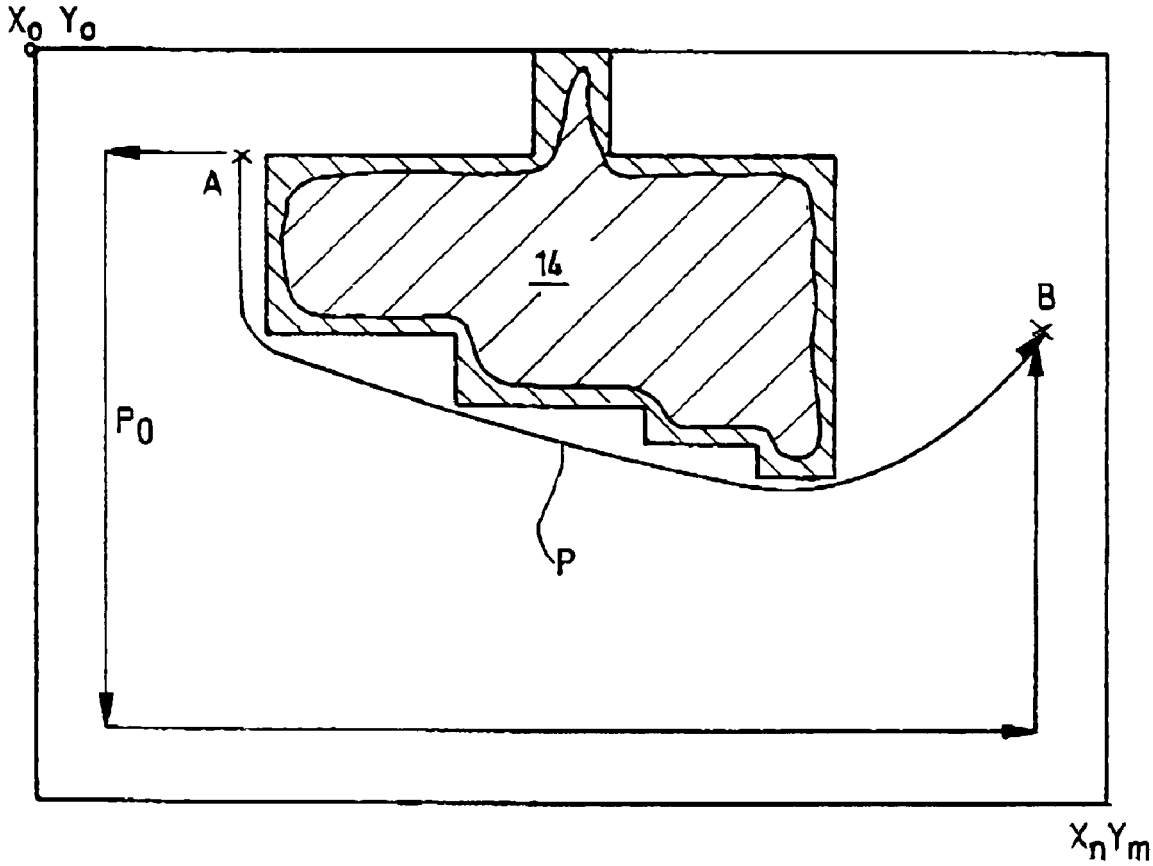
FIG. 6 shows in a schematic illustration the determination of a collision-free path around an obstacle separated in the working area in a two-dimensional example.

The control device 7 determines now a path P as it is shown with the aid of another two-dimensional example in FIG. 6 as follows:

A collision-free path is searched from A to B in the separated working area (here it is two-dimensional X, Y). Said path should be tolerably short. The areas at risk for collision are marked with hatch lines and they are respectively identified with "1" in the data base D. The method searches now a path in the grids provided by the separation that leads around the area at risk for collision. This path is furthermore an optimal path running directly along the inner area 14 and it is defined by a curved line whereby said area 14 identifies the collision zone. However, path P is considerably more favorable than a traditional through-going path $P_0$ leading across parked positions, which is shown schematically in FIG. 6.

Two-dimensional grids are not sufficient for the actual grinding machine 1 and therefore the operation has to be conducted correspondingly in the four-dimensional work area. Which means that the collision parameter "0" or "1" is determined and stored for all coordinate sets of fours X, Y, Z, A, which respectively identifies a possible relative position of tool and workpiece. This data base can then be used in the search for a path to determine if the selected path, or a recently determined partial path, or a partial path entered by the operator is collision-free or not—and this is accomplished by checking the stored values without any computing effort.

The collision parameters are preferably not only determined for a particular workpiece and a particular tool and for the entire multi-dimensional working area, but they are determined at the same time for all separated tools and all separated workpieces as well. This is illustrated in FIG. 3 and FIG. 4. FIG. 3 shows a supply of tools WZ1, WZ2, WZ3, which can include grinding wheels in all existing sizes and shapes within one set of grids, for example. In principle, the number of tool types is not limited thereby. There are three types in the present example. There are also shown several types of workpieces, particularly they are three types of workpieces for cylindrical unfinished pieces of different sizes. The different types or workpieces WS1, WS2, WS3 preferably differ respectively by one separation step within the given separation. Roughly stepped arrangements could also be selected as indicated in FIG. 4. Overlapping of all types of tools with all types of workpieces is now established for the entire separated working area R to produce the data base as illustrated in FIG. 5. This data base includes the collision parameters assigned to each point of the separated working area R for each possible pairing WZI, WSJ (whereby I and J respectively represent the number of the tool type and the workpiece type) and for possible relative positioning. The data set contains several gigabytes for a four-dimensional working area, even though each collision parameter requires only one bit, whereby the coordinates of said working area are respectively divided into one hundred separate steps. This applies also when a relatively low amount of only three types of tools and three types of workpieces are used, for example. It would take a highly efficient computer several days under certain circumstances to compute this amount of data. However, the produced set of data applies universally to the proposed type of grinding machine, which means that said data set can be copied without difficulties to any grinding machine manufactured. A new computation is not required then.

As mentioned above, the data set can be stored in compressed form. The data set is preferably divided into partial data sets whereby each partial data set represents a tool-workpiece pairing (DT=WZI overl WSJ/R). Only the partial data set has to be decompressed then to determine freedom of collision of a positioning path that applies to the specific tool or workpiece of interest. The decompressed data set can be used to determine or check a path whereby the result is available practically at once.

The data set D is made available for machine control of a grinding machine to determine time-efficient, collision-free paths whereby said data set has a collision parameter of "0" or "1" in each separated coordination point (X, Y, Z, A) and for each combination of the separated tool types WZI and workpiece types WSJ. Said collision parameter shows if a collision or spatial overlapping of the tool and the workpiece can occur or not for the constellation assigned to the corresponding coordinate point X, Y, Z, A, which means the relative position of the workpiece 11 and the tool 3. This data base D forms a lookup table that can be used to check given paths or for the expansion or for the step-by-step layout of a path. The computation of time-efficient paths can be performed in a few seconds even at limited computing capacity since the time-intensive and computing-intensive collision computation is eliminated thereby. The pre-computed lookup table is referred to for this purpose.

The invention claimed is:

1. A workpiece-shaping machine comprising:

a shaping tool carrier and a workpiece carrier arranged for relative movement in a plurality of directions within a working area;

a multi-axial actuation device for producing the relative movement; and a machine control device connected to the multi-axial actuation device and including:

a processing unit, and a memory unit connected to the processing unit and including a pre-computed data base for the working area, which area is divided into coordinates, wherein collision parameters are pre-assigned to the coordinates for predetermined shaping tools and predetermined workpieces in respective predetermined positions thereof, wherein the machine control device is operable to map out a freedom-from-collision travel path based upon the collision parameters.

2. The machine according to claim 1 wherein the data base includes all coordinates of the working area.

3. The machine according to claim 1 wherein the memory unit stores the shapes of respective workpieces in their unfinished state.

4. The machine according to claim 1 wherein the data base includes collision parameters for at least one workpiece type and for at least one tool type for the entire working area and for all assumable workpiece positions.

5. The machine according to claim 1 wherein the data base includes collision parameters for at least one workpiece type and for at least one tool type for the entire working area and for all assumable tool positions.

6. The machine according to claim 1, wherein the data base includes collision parameters for a plurality of workpiece types and a plurality of tool types for the entire working area and for all possible workpiece positions.

7. The machine according to claim 1, wherein the data base is compressed.

8. The machine according to claim 1, wherein the data base is divided into partial data bases, which includes the collision parameter for a workpiece-tool combination for all possible positions.

9. The machine according to claim 8, wherein the partial data bases are respectively compressed.

10. The machine according to claim 9 wherein the workpiece-shaping tools comprise grinding tools.

11. The machine according to claim 1 wherein the tool carrier is movable along three axes, and the workpiece is rotatable about an axis.

12. The machine according to claim 1, wherein the plurality of directions in which the shaping tool carrier is adapted to move includes at least X, Y and Z directions in an X-Y-Z coordinate system and the plurality of directions in which the workpiece carrier is adapted to move includes at least X, Y and Z directions in the X-Y-Z coordinate system; and the area is divided into the coordinates based on mobility of the shaping tool carrier and the workpiece carrier in the X, Y and Z directions, and the collision parameters are pre-assigned to the coordinates based on the mobility of the shaping tool carrier and the workpiece carrier in the X, Y and Z directions.

13. The machine according to claim 12, wherein:

at least one of the shaping tool carrier and the workpiece carrier can rotate about at least one of axis of the X-Y-Z coordinate system; and the area is divided into the coordinates further based on rotatability of at least one of the shaping tool carrier and the workpiece carrier, and the collision parameters are pre-assigned to the coordinates based on the rotatability of the shaping tool carrier and the workpiece carrier.

* * * * *